US006092683A

United States Patent [19]

Williams et al.

[11] Patent Number: 6,092,683

[45] Date of Patent: Jul. 25, 2000

[54] DECORATIVE ARTICLE

[76] Inventors: Charles T. Williams, 2592 Highland Rd.; G. Thomas Williams, 2640 Highland Rd., both of Zanesville, Ohio 43701

[21] Appl. No.: 09/425,537

[22] Filed: Oct. 22, 1999

Related U.S. Application Data

[63] Continuation-in-part of application No. 08/938,174, Sep. 26, 1997, Pat. No. 5,996,826.

[51] Int. Cl.[7] ..... B65D 37/00

[52] U.S. Cl. ..... 217/124; 217/3 BC; 220/495.11

[58] Field of Search ..... 217/3 BC, 124; 220/495.11; 4/901, 242.1, 245.5; 150/901

[56] References Cited

U.S. PATENT DOCUMENTS 2,511,481 6/1950 Schneider ..... 220/495.11

4,949,872 8/1990 Heaps, Jr. ..... 220/495.11

5,996,826 12/1999 Williams et al. ..... 217/124

*Primary Examiner*—Steven Pollard

*Attorney, Agent, or Firm*—Standley & Gilcrest LLP

[57] ABSTRACT

The present invention relates to a decorative article that is adapted to securely receive a decorative material without the use of nails, staples, screws, bolts, or adhesives. In general, the decorative article is comprised of a top side, a bottom side, a channel which separates the top side from the bottom side, and a material. The material is laid on the top side, and an adequate part of the material extends beyond the top side and into channel. The material is then secured to the decorative article simply by tucking the part of the material into the channel. The contact between the part of the material and the channel is sufficient to hold the part of the material in the channel without the use of nails, staples, screws, bolts, or adhesives.

18 Claims, 4 Drawing Sheets

DECORATIVE ARTICLE

The present application is a continuation-in-part of U.S. patent application Ser. No. 08/938,174, filed Sep. 26, 1997 entitled BASKET LID, now U.S. Pat. No. 5,996,826.

BACKGROUND AND SUMMARY OF THE INVENTION

The present invention relates generally to a decorative article, and more particularly, to a decorative article that is adapted to securely receive a decorative fabric without the use of nails, staples, screws, bolts, or adhesives. The present invention contemplates a decorative article with multiple uses. For example, such a decorative article may be used as a lid, as a peg board, as a shelf or as a wall-hanging.

A market demand currently exists for such a decorative article, particularly where a variety of decorative fabrics may be attached thereto. To meet this demand, known art has used means such as nails, staples, screws, bolts, and adhesives to secure said decorative fabrics. Although effective for securing fabric to a decorative article, such means typically require costs for parts, tools, and machinery. In addition, such means unnecessarily diminish the aesthetic appeal of the decorative article to which the fabric is attached.

In light of the deficiencies of known manufacturing processes, a need exists for a manufacturing process that does not use nails, staples, screws, bolts, or adhesives to secure fabric to a decorative article. A need also exists for a decorative article that has a decorative fabric secured to its surface in a manner that does not diminish the aesthetic appeal of the decorative article. The present invention is designed to address these needs. The present invention is also designed to reduce the cost of fabric-covered decorative articles and to allow the fabric to be replaced without defacing the decorative article.

In general, the fabric-covered decorative article of the present invention is comprised of a top side, a bottom side, a channel which separates the top side from the bottom side, and a fabric. The fabric is laid on the top side, and an adequate part of the fabric extends beyond the top side and overhangs the channel. The fabric is then secured to the decorative article simply by tucking the part of the fabric into the channel. The contact between the part of the fabric and the channel is sufficient to hold the part of the fabric in the channel without the use of nails, staples, screws, bolts, or adhesives.

The present invention, however, is not limited to a decorative article that is decorated with a single layer of fabric. The material used to decorate the decorative article may be comprised of a single layer or multiple layers. Moreover, any flexible article such as cloth, foam, padding, or plastic may be substituted for the fabric. Similarly, the material may be comprised of layers of flexible articles including, but not limited to, fabrics, cloths, foams, padding, and plastic.

In addition to the novel features and advantages mentioned above, other objects and advantages of the present invention will be readily apparent from the following descriptions of the drawings and preferred embodiments.

DETAILED DESCRIPTION OF PREFERRED EMBODIMENT(S)

The present invention is directed to a decorative article that is adapted to securely receive a decorative material without the use of nails, staples, screws, bolts, or adhesives. In performing this function, the present invention provides a simple, yet effective, process to secure decorative material to a decorative article. In addition, the decorative material can be changed an unlimited number of times without damaging or defacing the decorative article. By achieving these objectives, the present invention provides a decorative article that is labor efficient and cost efficient. Moreover, the present invention meets the market demand for a simple, yet versatile decorative article design.

Figure 1:
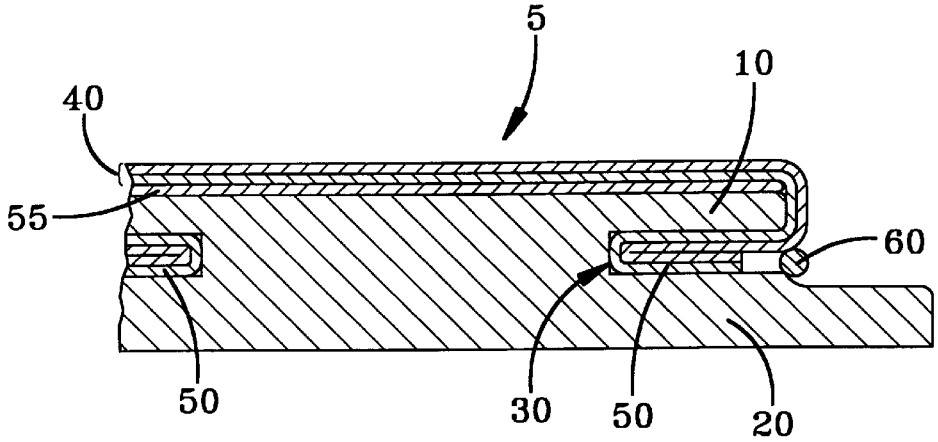
FIG. 1 is a cross-sectional view of a preferred embodiment of the present invention.

FIG. 1 illustrates a cross-sectional view of a preferred embodiment of the present invention. The decorative article 5 has a top side 10, a bottom side 20, and a channel 30. It is well known in the art that the decorative article 5 may have a uni-body construction. However, those skilled in the art also know that the top side 10 and the bottom side 20 may be separate units which are joined together by means such as adhesives, screws, nails, bolts, and/or staples.

The channel 30 has an interior surface which separates the top side 10 from the bottom side 20. The interior surface of the channel 30 may have a smooth finish. However, rough edges may also be created on the interior surface of the channel 30.

The channel 30 may be created by hollowing out an area between the top side 10 and the bottom side 20. The channel 30 may also be created by joining together separate units of the top side 10 and the bottom side 20. Regardless of the method used to create the channel 30, the depth and height of the channel 30 are only limited by the size of the decorative article 5. However, a preferred range for the depth of the channel 30 is 0.25 to 1.50 inches, and a preferred range for the height of the channel 30 is 0.01 to 0.40 inches.

A material 40 may be used to decorate the decorative article 5. The material 40 may be comprised of a single layer or multiple layers. In a preferred embodiment of the present invention, the material 40 is a single layer of fabric. However, the fabric may be replaced by any flexible article including, but not limited to, cloth, foam, padding, or plastic. Similarly, the material 40 may be comprised of layers of flexible articles including, but not limited to, fabrics, cloths, foams, padding, and plastics.

In order to secure the material 40 to the decorative article 5 without the use of nails, staples, screws, bolts, or adhesives, an adequate portion 50 of the material 40 is tucked into the channel 30. In a preferred embodiment of the present invention, there is sufficient contact between the portion 50 of the material 40 and the interior surface of the channel 30, to hold the portion 50 of the material 40 in the channel 30.

In a preferred embodiment of the present invention, the material 40 covers the top side 10 of the decorative article 5. In this embodiment, the material 40 is laid on the top side 10 of the decorative article 5, with an adequate amount of the material 40 extending beyond the top side 10 of the decorative article 5 and overhanging the channel 30. The overhanging portion 50 of the material 40 is tucked into the channel 30, whereby there is sufficient contact between the portion 50 of the material 40 and the interior surface of the channel 30 to secure the portion 50 of the material 40 to the decorative article 5.

A pad 55 may be utilized to cushion the top side 10 of the decorative article 5. For this purpose, the pad 55 is placed on the top side 10 of the decorative article 5 prior to laying the material 40 on the top side 10 of the decorative article. Consequently, at least a portion of the pad 55 rests between the top side 10 of the decorative article and the material 40 that covers the top side 10 of the decorative article 5.

Figure 2:
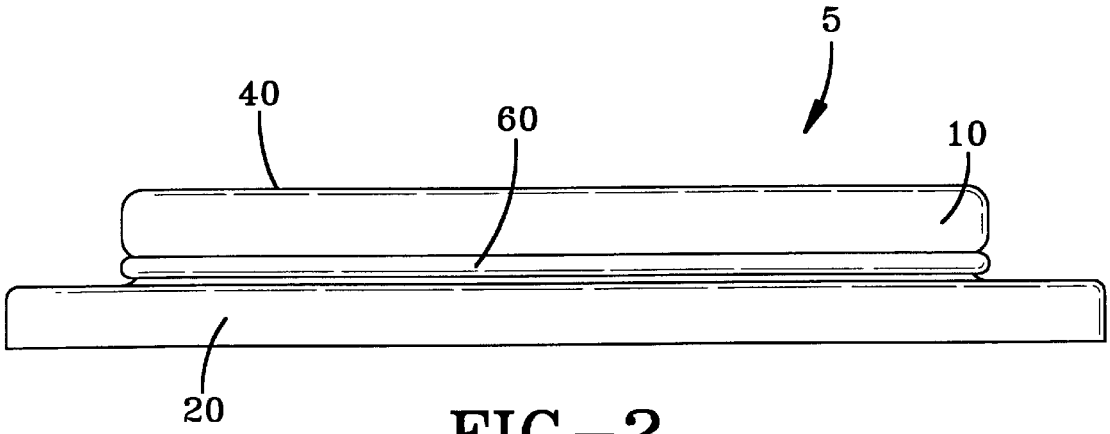
FIG. 2 is a side elevational view of a preferred embodiment of the present invention.
Figure 3:
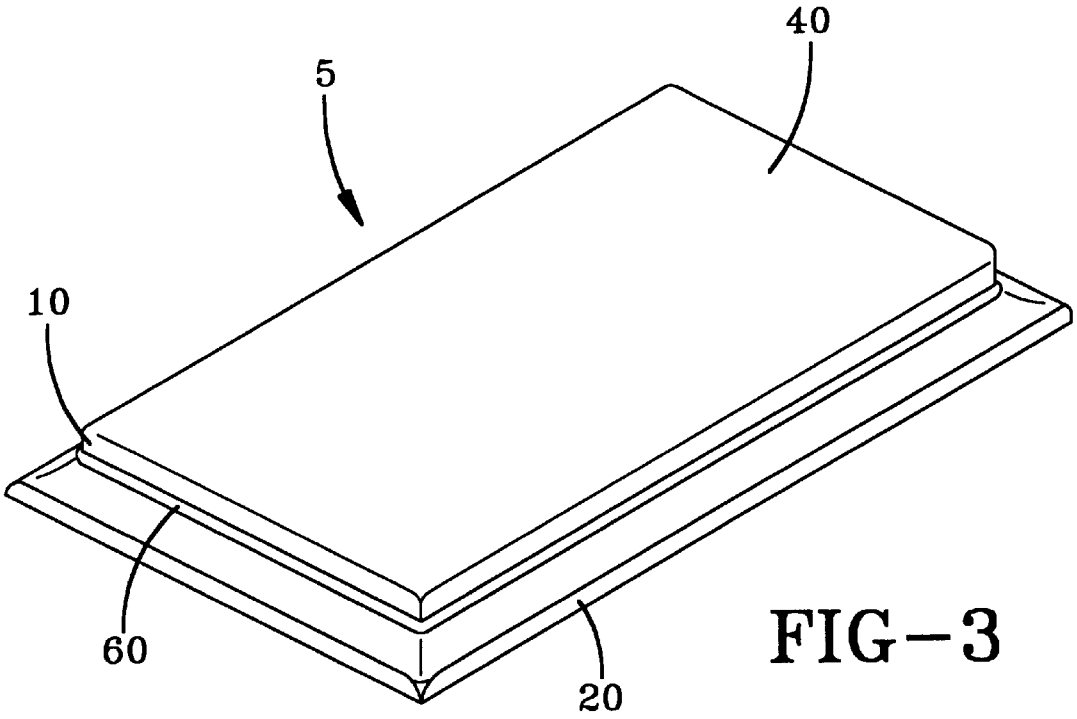
FIG. 3 is a perspective view of a preferred embodiment of the present invention.

In addition to the contact between the portion 50 of the material 40 and interior surface of the channel 30, other measures may be taken to further prevent the portion 50 of the material 40 from falling out of the channel 30. These measures may be used alone or in combination with the others. For instance, rough edges may be created on the interior surface of the channel 30 to help hold the portion 50 of the material 40 in the channel 30. Also, as shown in FIGS. 2 and 3, a band 60 may be wrapped around the channel 30 after the portion 50 of the material 40 has been tucked into the channel 30. By wrapping the band 60 sufficiently tight around the channel 30, the band 60 serves to help prevent the portion 50 of the material 40 from falling out of the channel 30.

Figure 4:
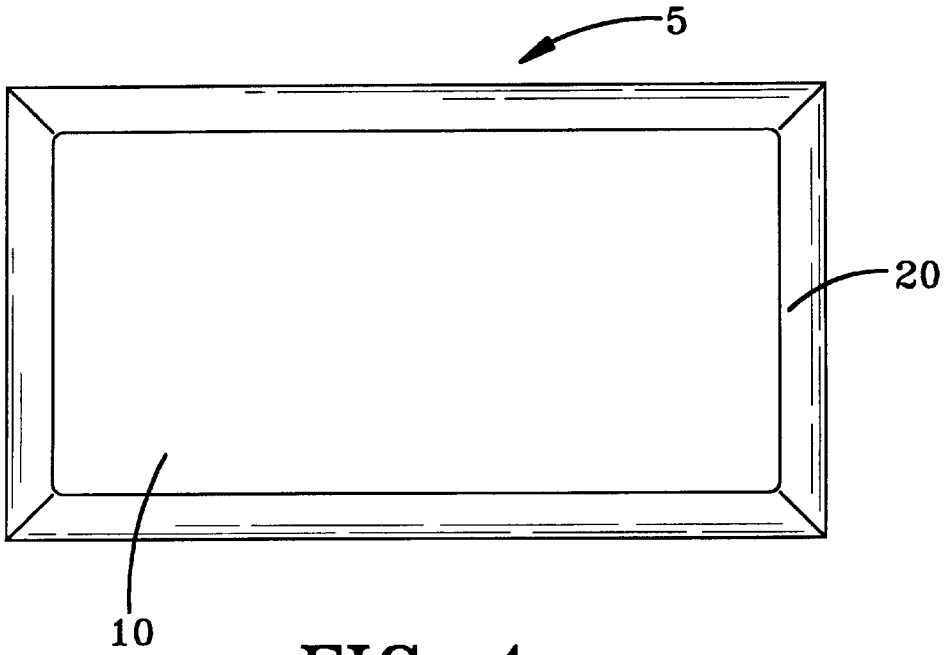
FIG. 4 is a top view of a preferred embodiment of the present invention.
Figure 5:
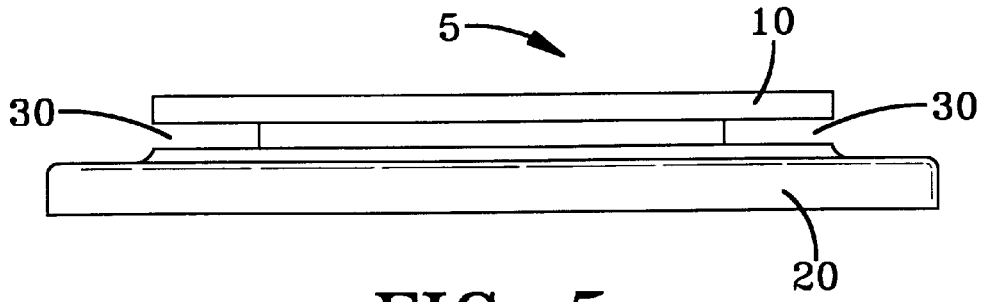
FIG. 5 is a side elevational view of a preferred embodiment of the present invention prior to covering with a decorative material.

FIGS. 4 and 5 illustrate a preferred embodiment of a decorative article 5 that is adapted to receive a decorative material. FIG. 4 is a top plan view that illustrates the top side 10 and the bottom side 20. FIG. 5 is a side elevational view that shows the relationship of the channel 30 to the top side 10 and the bottom side 20.

Figure 6:
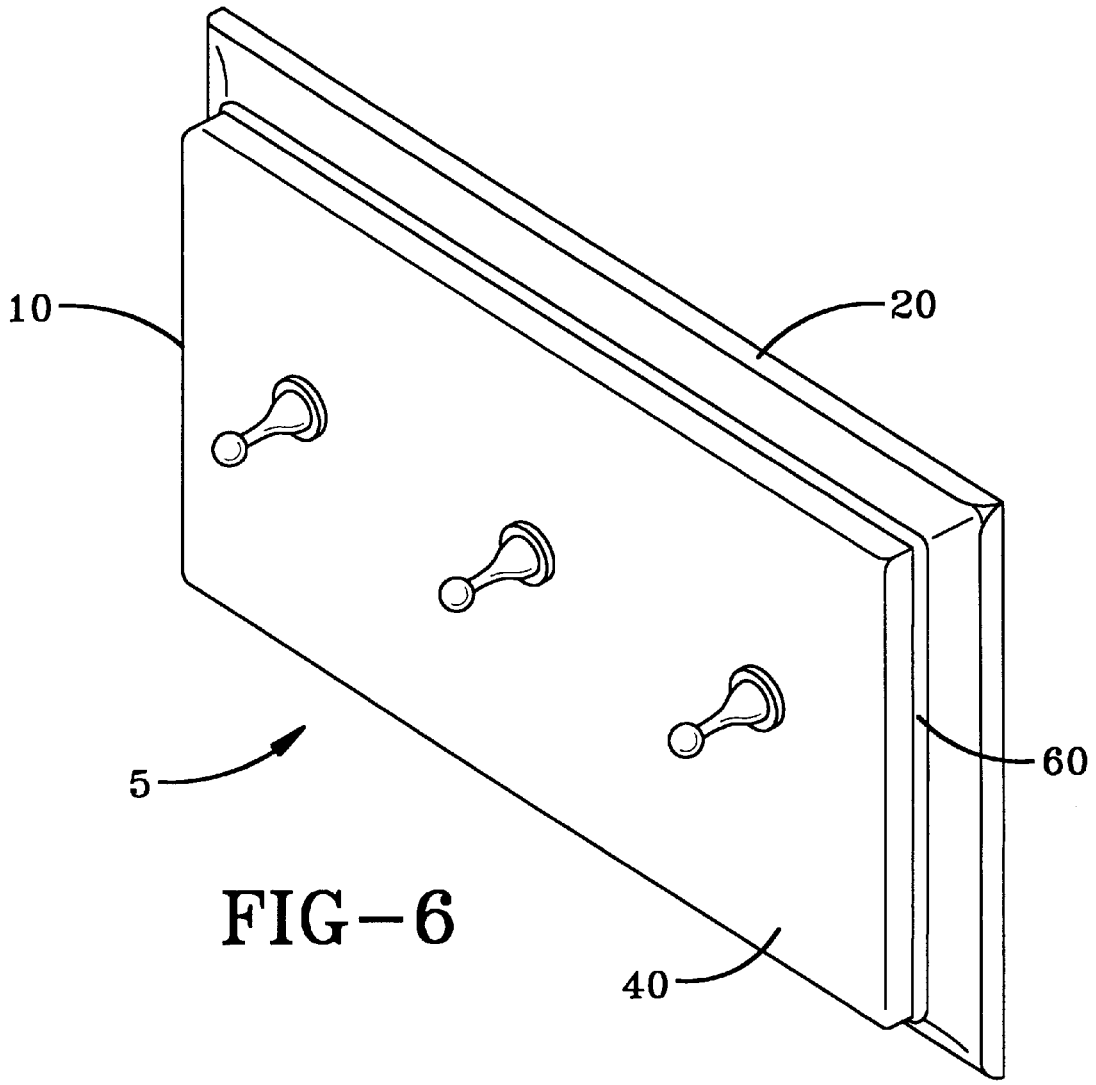
FIG. 6 is a perspective view showing the present invention embodied as a peg board.
Figure 7:
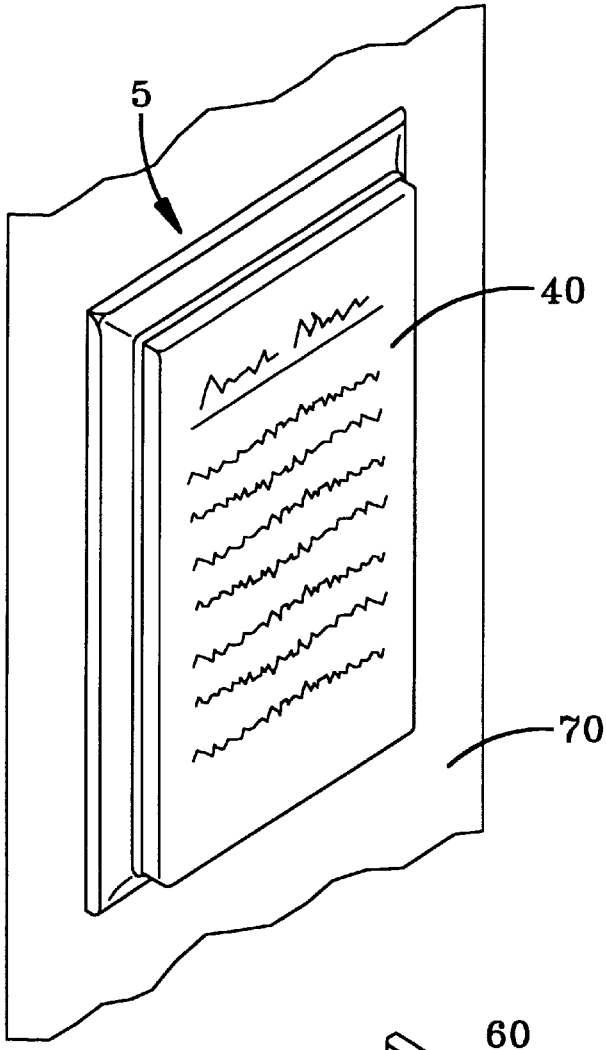
FIG. 7 is a perspective view showing the present invention embodied as a decorative wall hanging.
Figure 8:
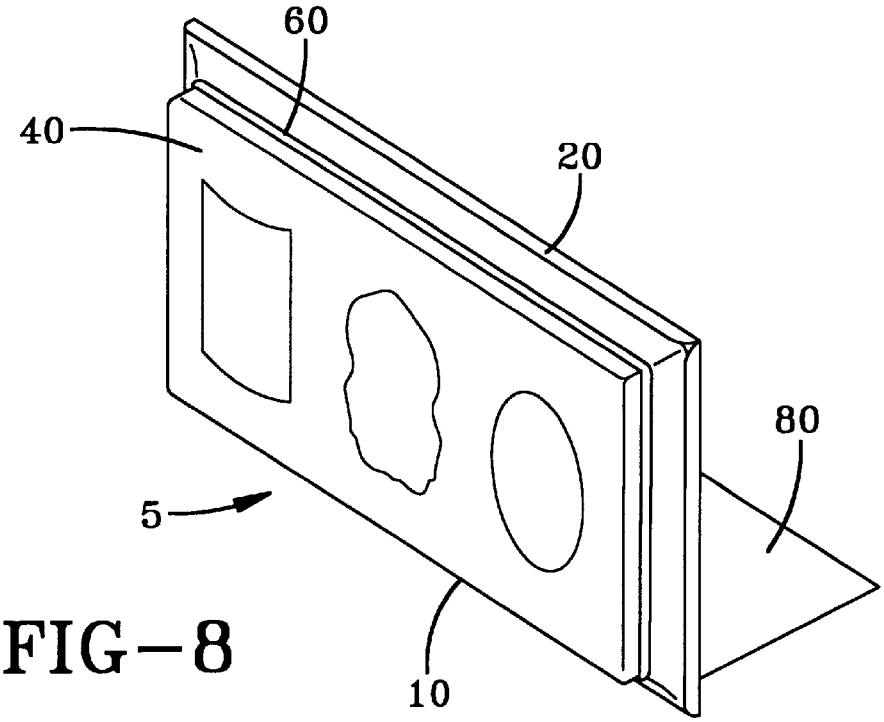
FIG. 8 is a perspective view showing the present invention adapted to rest on its side.

FIGS. 6 through 8 illustrate other preferred embodiments of the decorative article 5 of the present invention. FIG. 6 is a perspective view that shows the decorative article 5 configured for use as a peg board. In such an embodiment, the decorative article 5 may be used to hang cups, coats, hats, or numerous other items. FIG. 7 is a perspective view depicting the decorative article 5 of the present invention in the configuration of a wall hanging. Although the decorative article 5 is shown hanging on a wall 70, it should be realized that the decorative article may be affixed to virtually any surface. The decorative material 40 may display an artwork or a transferred photograph, or may contain a poem or a writing, for example. In FIG. 8 the decorative article 5 is modified to sit on a flat surface, such as a table. In this particular embodiment, a bracket 80 is attached to the back of the decorative article 5 to enable the decorative article to stand upright. Again, the decorative material 40 may be an artwork or a transferred photograph, or may contain a poem, a writing, or countless other displays.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A peg board comprising:

a top side;

a bottom side;

a channel having a width based on the thickness of a covering material and having an interior surface that separates the top side from the bottom side;

at least one boss extending from the top surface of the peg board; and a material for covering the top side, said material of sufficient size such that a portion thereof extends beyond the top side and into the channel;

whereby the friction between the material and the interior surface of the channel is sufficient to hold the material in the channel independent of any secondary fastening means.

2. The peg board of claim 1, wherein the material has multiple layers.

3. The peg board of claim 1, wherein the interior surface of the channel has rough edges, said rough edges further preventing the portion of the material residing in the channel from becoming dislodged.

4. The peg board of claim 1 further comprising a band wrapped around the channel, said band further preventing the portion of the material residing in the channel from becoming dislodged.

5. The peg board of claim 1 further comprising a pad for cushioning the top side of the peg board, at least a portion of said pad resting between the top side and the material that covers the top side.

6. The peg board of claim 1, wherein the peg board is adapted to hang on a substantially vertical surface.

7. The peg board of claim 1, wherein the boss is a peg.

8. The peg board of claim 1, wherein the boss is a hook.

9. A decorative article comprising:

a top side;

a bottom side;

a channel having a width based on the thickness of a covering material and having an interior surface that separates the top side from the bottom side; and a material for covering the top side, said material of sufficient size such that a portion thereof extends beyond the top side and into the channel;

whereby the friction between the material and the interior surface of the channel is sufficient to hold the material in the channel independent of any secondary fastening means.

10. The decorative article of claim 9, wherein the material has multiple layers.

11. The decorative article of claim 9 wherein the interior surface of the channel has rough edges, said rough edges further preventing the portion of the material residing in the channel from becoming dislodged.

12. The decorative article of claim 9 further comprising a band wrapped around the channel, said band further preventing the portion of the material residing in the channel from becoming dislodged.

13. The decorative article of claim 9 further comprising a pad for cushioning the top side of the decorative article, at least a portion of said pad resting between the top side and the material that covers the top side.

14. The decorative article of claim 9, wherein the decorative article is adapted to hang on a substantially vertical surface.

15. The decorative article of claim 9, wherein the decorative article is adapted to rest on a substantially horizontal surface.

16. The decorative article of claim 9, wherein at least one peg extends from the top surface of the decorative article.

17. The decorative article of claim 9, wherein at least one hook is attached to the top surface of the decorative article.

18. The peg board of claim 1, wherein the at least one boss extends through the material.

* * * * *